US009272857B2

(12) United States Patent
Nakagawa et al.

(10) Patent No.: US 9,272,857 B2
(45) Date of Patent: Mar. 1, 2016

(54) SHEET STACKING APPARATUS, SHEET FEEDING APPARATUS, AND IMAGE FORMING APPARATUS

(71) Applicant: CANON KABUSHIKI KAISHA, Tokyo (JP)

(72) Inventors: Tomohito Nakagawa, Kashiwa (JP); Hideki Kushida, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/585,577

(22) Filed: Dec. 30, 2014

(65) Prior Publication Data

US 2015/0191321 A1 Jul. 9, 2015

(30) Foreign Application Priority Data

Jan. 8, 2014 (JP) ..... 2014-001948

(51) Int. Cl.
*B65H 1/12* (2006.01)

(52) U.S. Cl.
CPC ..... *B65H 1/12* (2013.01); *B65H 2405/11151* (2013.01)

(58) Field of Classification Search
CPC ..... B65H 1/12; B65G 2405/1116; B65G 2405/11163; B65G 2405/11151
USPC ..... 271/148, 160
See application file for complete search history.

(56) References Cited

U.S. PATENT DOCUMENTS

| | | | | |
|---|---|---|---|---|
| 5,351,112 | A | 9/1994 | Naito et al. | |
| 5,455,667 | A | 10/1995 | Hiroi et al. | |
| 5,552,859 | A | 9/1996 | Nakagawa et al. | |
| 5,579,083 | A | 11/1996 | Naito et al. | |
| 5,611,527 | A * | 3/1997 | Wuthrich | 271/133 |
| 5,819,151 | A | 10/1998 | Naito et al. | |
| 6,142,689 | A * | 11/2000 | Margiotta | 400/624 |
| 6,837,490 | B2 * | 1/2005 | Hirai et al. | 271/148 |
| 7,874,553 | B2 | 1/2011 | Kushida et al. | |
| 8,550,461 | B2 | 10/2013 | Sekigawa et al. | |
| 8,651,480 | B2 | 2/2014 | Watanabe et al. | |
| 8,752,837 | B2 | 6/2014 | Iwata et al. | |
| 2015/0021850 | A1 | 1/2015 | Nakagawa et al. | |
| 2015/0042037 | A1 | 2/2015 | Nakagawa et al. | |

FOREIGN PATENT DOCUMENTS

JP 11-035175 A 2/1999

* cited by examiner

*Primary Examiner* — Michael McCullough
(74) *Attorney, Agent, or Firm* — Fitzpatrick, Cella, Harper & Scinto

(57) ABSTRACT

A sheet stacking apparatus includes a base member, a sheet stacking portion on which sheets are stacked, and a biasing portion configured to bias the sheet stacking portion.

The sheet stacking portion is swingably supported by the base member, and the biasing portion biases the sheet stacking portion such that a swing angle is reduced.

12 Claims, 11 Drawing Sheets

SHEET STACKING APPARATUS, SHEET FEEDING APPARATUS, AND IMAGE FORMING APPARATUS

BACKGROUND OF THE INVENTION

1. Field of the Invention

This disclosure relates to a sheet stacking apparatus, a sheet feeding apparatus, and an image forming apparatus.

2. Description of the Related Art

Nowadays, in image forming apparatus such as copying machines, printers, and facsimiles, those configured to form images on a sheet fed from a sheet feeding apparatus by an image forming portion is widely used. The sheet feeding apparatus is generally configured to demountably mount a sheet feeding cassette as a sheet storage portion configured to store sheets in an apparatus main body, and feed the sheets stored in the sheet feeding cassette by a pickup roller provided on the apparatus main body automatically.

Examples of the sheet feeding apparatus of this type include those including a tray configured to be moved upward and downward by an elevating unit so as to feed the sheets stacked on the tray of the sheet feeding cassette by pressing with a pickup roller. In addition, the sheet feeding cassette is slidably provided with a trailing end regulating unit configured to regulate positions of upstream ends of the sheets stacked on the tray in the sheet feeding direction (hereinafter, referred to as a trailing end) so as to allow sheets of different sizes to be stored. In addition, the sheet feeding cassette is provided with a pair of side end regulating units configured to regulate side end positions of the sheets stacked on the tray in a direction orthogonal to a sheet feeding direction (hereinafter, referred to as a width direction).

When feeding the sheet, side ends of the sheets on the tray are regulated by the pair of side end regulating units, and trailing ends of the sheets on the tray are regulated by the trailing end regulating unit, so that the positions of the sheets are regulated at predetermined positions. Thereafter, the tray is moved upward by the elevating unit, and the pickup roller is pressed against the sheets stacked thereon, and rotates to feed the sheets.

Examples of the sheet feeding apparatus of the related art include a type configured to feed sheets having an uneven thickness such as envelopes. Examples of the sheet feeding apparatus of this type include those configured to be provided with a specific middle plate and press the sheets stacked on the middle plate from above by a press roller in order to stack a larger amount of the sheets having an uneven thickness as disclosed in Japanese Patent Laid-Open No. H11-35175. When feeding the sheets, the middle plate is pressed by the pickup roller provided above with a spring, and the pickup roller is rotated while pressing the sheets by the press roller to feed the sheet.

In the sheet feeding apparatus of the related art having the configuration as described above, sheet conveying properties are improved to some extent by pressing a bundle of sheets having an uneven thickness with the spring or the roller to bring postures of the sheets horizontal. However, in the case where the sheets are envelopes, each envelope is provided with a flap 23 for closing an opening as illustrated in FIG. 9. Since the shape of this flap 23 does not have a shape covering an entire surface of an envelope P but has a shape covering part of the surface of the envelope P, the thickness of a portion of the envelope P covered by the flap 23 becomes thicker than other portions. In other words, the envelope P is formed by folding a sheet into a bag shape and, in addition, the flap 23 is further folded at an end, so that the envelope P includes a portion having a double thickness of the sheet and a portion having a triple thickness of the sheet.

Therefore, when stacking the envelopes P in the same orientation, the height H1 on a side where the flaps 23 are located is higher than a height H2 on the side where the flaps 23 are not located. The larger the number of the envelopes P to be stacked, the larger the difference between the heights H1 and H2 of the bundle of the envelopes P becomes, so that a topmost envelope P1 is inclined significantly.

FIG. 10 illustrates a state in which the number of the envelopes P to be stacked is large, and the topmost envelope P1 is significantly inclined in accordance with an increase of the number of the stacked envelopes P. In FIG. 10, reference numeral 100 denotes a pickup roller configured to feed the envelope, and reference numeral 108 denotes a middle plate capable of moving upward and downward. The middle plate 108 is controlled to move upward and downward in accordance with the height of the pickup roller 100. Reference numerals 110 and 111 denote side regulating plates configured to regulate the side end positions of the envelopes P. Reference numeral 114 denotes a side wall on the downstream side of the storage, not illustrated, configured to store the envelopes P in the feeding direction.

When the topmost envelope P1 is inclined, the pickup roller 100 comes into abutment with an upper surface of the topmost envelope P1 at only one end of the pickup roller 100 in the width direction, that is, a state of so-called one-side abutment, and hence cannot come into abutment with the upper surface of the topmost envelope P1 uniformly. In this case, a feeding force of the pickup roller 100 is not transmitted to the envelope P1 uniformly, so that a feed error due to slippage or skew caused by the one-side abutment may occur. Since the topmost envelope P1 is inclined, a portion of the topmost envelope P1 on the lower side is located on the lower side of the side wall 114, and if the envelope P1 is fed in this state, the envelop P1 abuts against the side wall 114 and hence cannot be fed. In this manner, when a number of the envelopes are stacked, the difference in height in the stacking direction of the envelopes is increased. Therefore, there is a problem that the envelope cannot be fed reliably.

SUMMARY OF THE INVENTION

This disclosure provides a sheet stacking apparatus for supporting stacked sheets within a sheet storage portion, the sheet stacking apparatus including abase member, a sheet stacking portion on which sheets are stacked, the sheet stacking portion being supported by the base member such that both end portions of the sheet stacking portion swing up and down about a swinging center, and a biasing portion configured to bias the sheet stacking portion to reduce a swing angle.

Further features of the present invention will become apparent from the following description of exemplary embodiments with reference to the attached drawings. The accompanying drawings, which are incorporated in and constitute apart of the specification, illustrate exemplary embodiments, features, and aspects of the invention and, together with the description, serve to explain the principles of the invention.

DESCRIPTION OF THE EMBODIMENTS

Figure 1:
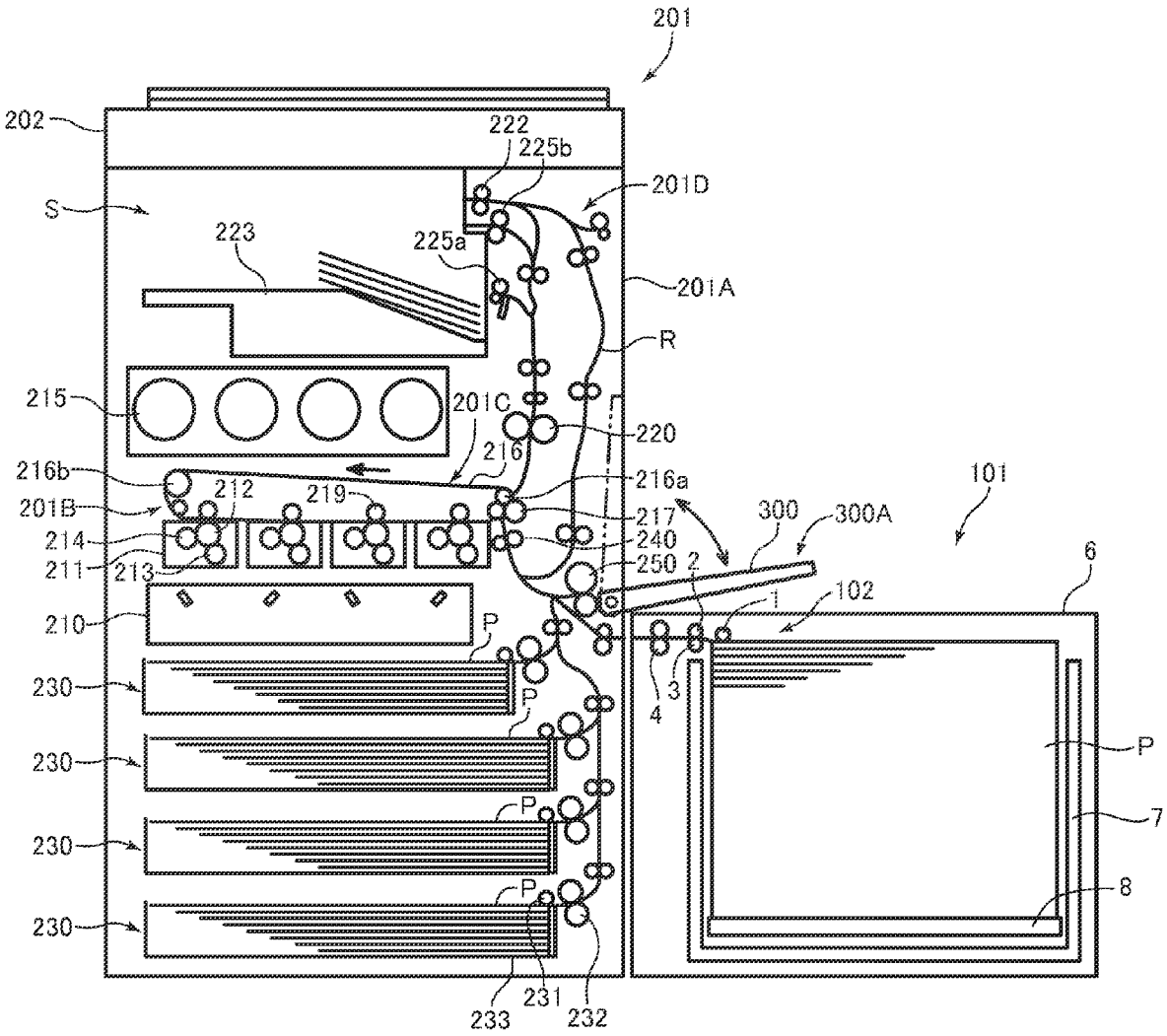
FIG. 1 is a drawing illustrating a general configuration of a full-color laser beam printer that is an example of an image forming apparatus including a sheet feeding apparatus according to an embodiment of this disclosure.

Hereinafter, a mode for carrying out this disclosure will be described in detail with reference to the drawings. FIG. 1 is a drawing illustrating a general configuration of a full-color laser beam printer that is an example of an image forming apparatus including a sheet feeding apparatus according to an embodiment of this disclosure.

In FIG. 1, reference numeral 201 denotes a full-color laser beam printer (hereinafter, referred to as a printer), reference numeral 201A denotes a printer body as an image forming apparatus body, reference numeral 201B denotes an image forming portion configured to form an image on a sheet, and reference numeral 220 denotes a fixing unit. Reference numeral 202 denotes an image reading unit as an upper apparatus installed above the printer body 201A substantially horizontally, and a discharge space S for discharging a sheet is formed between the image reading unit 202 and the printer body 201A.

Reference numeral 230 denotes a sheet feeding apparatus provided in a lower portion of the printer body 201A, reference numeral 300A denotes a manual sheet feed unit provided on one side of the printer body 201A and including an opening and closing tray 300 which allows manual insertion. Reference numeral 101 denotes a large-capacity sheet deck connected on one side of the printer body 201A. Reference numeral 215 denotes a toner cartridge.

The image forming portion 201B is of a four-drum full-color system, and includes a laser scanner 210, and four process cartridges 211 configured to form toner images in four colors of yellow (Y), magenta (M), cyan (C), and black (K). Each of the process cartridges 211 includes a photosensitive drum 212, a charger 213, a developer 214, and a cleaner, not illustrated. The image forming portion 201B includes an intermediate transfer unit 201C arranged above the process cartridges 211.

The intermediate transfer unit 201C includes an intermediate transfer belt 216 wound around a drive roller 216*a* and a tension roller 216*b*. The intermediate transfer unit 201C is provided inside the intermediate transfer belt 216 and is provided with a primary transfer roller 219 configured to come into abutment with the intermediate transfer belt 216 at positions opposing the photosensitive drums 212. The intermediate transfer belt 216 is formed of a film-shaped member, is arranged so as to come into contact with the respective photosensitive drums 212, and is configured to be rotated in a direction of an arrow by the drive roller 216*a* driven by a drive unit, not illustrated.

By applying a transfer bias of a positive polarity to the intermediate transfer belt 216 by the primary transfer roller 219, the respective color toner images on the photoconductive drums having a negative polarity are sequentially transferred to the intermediate transfer belt 216 in a superimposed manner. Accordingly, a full-color image is formed on the intermediate transfer belt. At a position of the intermediate transfer unit 201C opposing the drive roller 216*a*, a secondary transfer roller 217 composing a secondary transfer unit configured to transfer the color image formed on the intermediate transfer belt to the sheet P is provided.

In addition, the fixing portion 220 is arranged above the secondary transfer roller 217, and a first discharge roller pair 225*a*, a second discharge roller pair 225*b*, and a both-side inversing portion 201D as a surface reverse discharging portion are arranged at an upper left position of the fixing portion 220. The both-side inverting portion 201D includes an inverting roller pair 222 as a sheet inverting and conveying roller configured to rotate in the normal direction and a reverse direction, and a re-transporting passage R configured to convey the sheet on which the image is formed on one side again to the image forming portion 201B.

The sheet feeding apparatus 230 includes a cassette 233, and a pickup roller 231 configured to feed the sheets P stored in the cassette 233. The sheet deck 101 as the sheet storage portion includes a storage 7 configured to stack and store a large number of the sheets P, and a sheet feeding apparatus 102 configured to feed the sheet stored in the storage 7. The storage 7 as the sheet storage portion body is provided so as to be capable of being pulled out from a housing 6, and includes a lifter tray (supporting portion) 8 on which the sheets are stacked, configured to be capable of moving upward and downward. The lifter tray 8 is suspended with a wire or the like, not illustrated, and is configured to be capable of being controlled to move upward and downward in a horizontal state by a winding rotary drive of a wire pulley coupled to a motor drive.

The sheet feeding apparatus 102 includes a first feed roller 1 as a sheet feed portion configured to feed sheets stacked on the lifter tray 8, and a second feed roller 2 and a retard roller 3 constituting part of a separating unit configured to separate the fed sheets into pieces and convey the separated sheets by the first feed roller 1 one by one. The first feed roller 1, the second feed roller 2, and the retard roller 3 are rollers in which a member having a high friction coefficient such as rubber is wound around a periphery thereof.

Subsequently, an image forming operation of the printer 201 will be described. First of all, when image information on a document is read by the image reading unit 202, the image information is subjected to image processing, then is converted into an electric signal, and transmitted to the laser scanner 210 of the image forming portion 201B. In the image forming portion 201B, surface of the photosensitive drums 212 charged uniformly to predetermined polarity and potential by the chargers 213 are exposed in sequence by a laser beam. Accordingly, electrostatic latent images of yellow, magenta, cyan, and black are formed in sequence on the photoconductive drums of the respective process cartridges 211.

Then, the electrostatic latent images are visualized by being developed by the toners of the respective colors and the respective color toner images on the respective photosensitive drums are overlapped and transferred in sequence on the intermediate transfer belt 216 by a primary transfer bias applied to the primary transfer roller 219. Accordingly, a toner image is formed on the intermediate transfer belt 216.

In parallel to the toner image forming action, the sheet P stored in the cassette 233 is fed from the pickup roller 231 provided in the sheet feeding apparatus 230. The fed sheet P is conveyed to a registration roller pair 240 after having separated into pieces by the separating unit 232, and a skew is corrected by the registration roller pair 240. In the case of the manual insertion feeding, the sheet set on the opening and closing tray 300 is conveyed by the second feed roller 250 toward the registration roller pair 240.

In the case where sheet feeding from the sheet deck 101 is specified, the sheet is fed by the first feed roller 1, and the fed sheet is conveyed to the registration roller pair 240 by the second feed roller 2 and a pull-out roller 4. There is a case where two or more sheets are fed by the first feed roller 1. In such a case, entry of the second sheets onward into a nip portion between the second feed roller 2 and the retard roller 3 is blocked by the retard roller 3, so that only the first sheet is conveyed.

After having corrected the skew, the sheet P is conveyed to the secondary transfer unit by the registration roller pair 240, and in the second transfer unit, the toner image is transferred in a lump onto the sheet P by a secondary transfer bias applied to the secondary transfer roller 217. Subsequently, the sheet P to which the toner image is transferred is conveyed to the fixing portion 220, and the respective color toners are melted and mixed by being applied with heat and pressure in the fixing portion 220, so that a color image is fixed to the sheet P.

Subsequently, the sheet P having the image fixed thereon is discharged into the discharge space S by the first discharge roller pair 225*a* and the second discharge roller pair 225*b*, provided downstream of the fixing portion 220, and is stacked on a stacking portion 223 protruding from a bottom surface of the discharge space S. When forming an image on both sides of the sheet P, after the image has been fixed, the sheet P is conveyed to the re-transporting passage R by the inverting roller pair 222, and then conveyed again to the image forming portion 201B.

Figure 2:
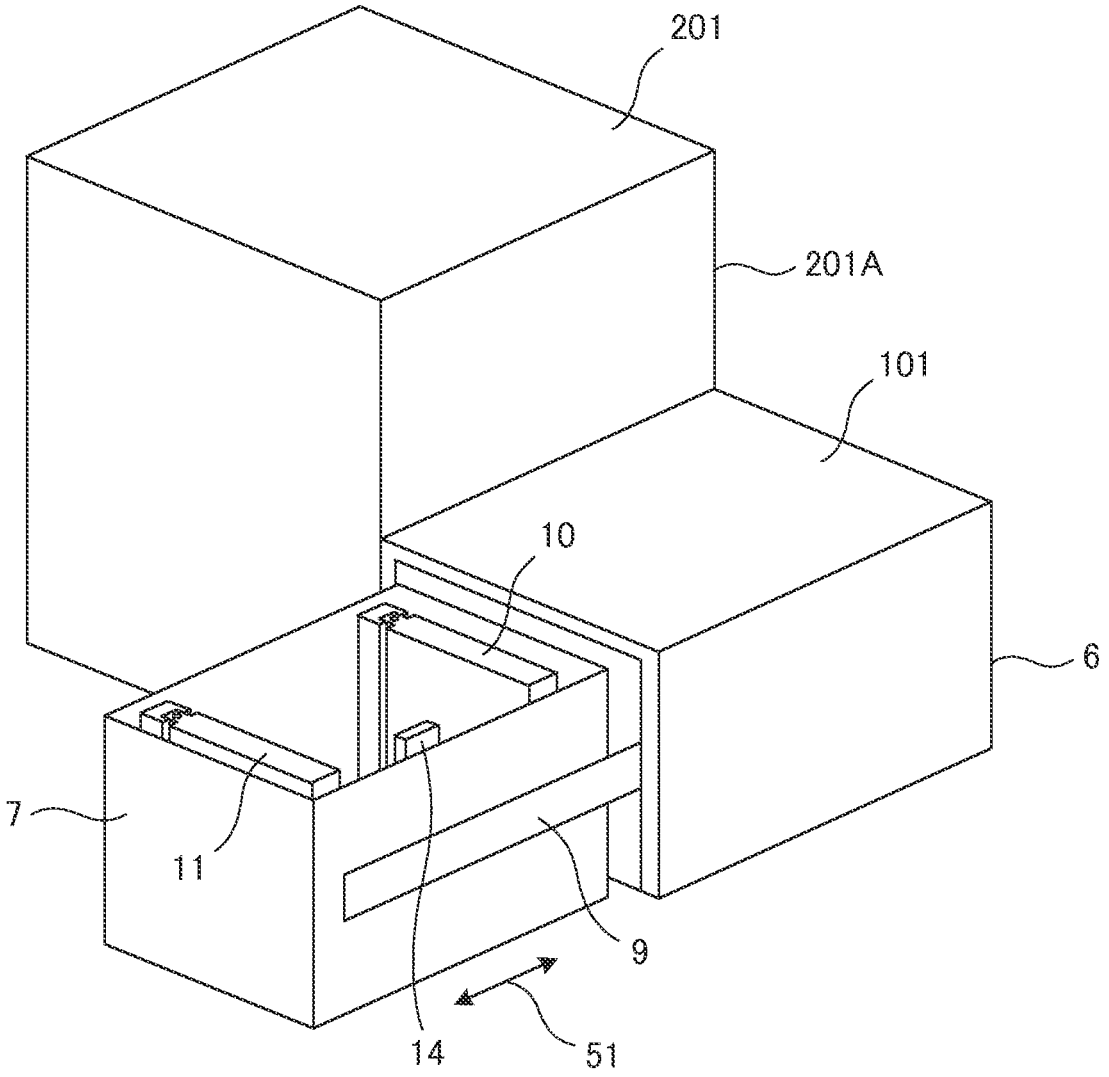
FIG. 2 is a drawing illustrating a state in which a storage is pulled out from a sheet deck mounted on the full-color laser beam printer.

FIG. 2 is a drawing illustrating a state in which the storage 7 provided in the sheet deck 101 so as to be free to be pulled out in a direction indicated by an arrow 51 is pulled out toward a user from the sheet deck 101. When storing the sheets in the sheet deck 101, the storage 7 is pulled out to secure an operating space for storing the sheets on an upper part thereof to stack the sheets on the lifter tray 8.

In FIG. 2, reference numeral 9 denotes a slide rail arranged on an outer wall surface of the storage 7 on the upstream side in the sheet feeding direction for pulling out the storage 7 from the housing 6, and the slide rail is arranged on the outer wall surface of the storage 7 on the downstream side in the sheet feeding direction. Reference numerals 10 and 11 denote side regulating members configured to regulate side end positions (positions in the width direction) of the sheet in the width direction orthogonal to the sheet feeding direction, reference sign 14 denotes a trailing end regulating member configured to regulate a position of a trailing end of the sheet, which is an upstream end of the sheet in the sheet feeding direction.

After the sheets are stacked on the lifter tray 8, the side regulating members 10 and 11 and the trailing end regulating member 14 are set so as to meet the size of the sheet P, and then the storage 7 is closed. Accordingly, the lifter tray 8 moves upward, and then the topmost sheet of the sheet P abuts against the first feed roller 1 as the sheet feed portion. In the interior of the housing 6, a sensor, not illustrated, configured to detect the fact that the height of the first feed roller 1 reaches a position where the sheet may be fed is provided.

Subsequently, when the lifter tray 8 moves further upward, and the first feed roller 1 is further pushed upward, the position of the first feed roller 1 moved upward is detected by the sensor, not illustrated, and a control unit, not illustrated, stops the upward movement of the lifter tray 8 by a signal from the sensor that detects the first feed roller 1. Accordingly, feeding of the sheet is enabled. When the feed of the sheet is started to lower the height of the bundle of the sheets P and thus the first feed roller 1 is moved downward, the control unit moves the lifter tray 8 upward by a non-detection signal from the sensor. Accordingly, the position of the upper surface of the sheet P is maintained within a range of a certain height direction, and the uppermost sheets are fed by the first feed roller 1 in sequence.

Figure 3:
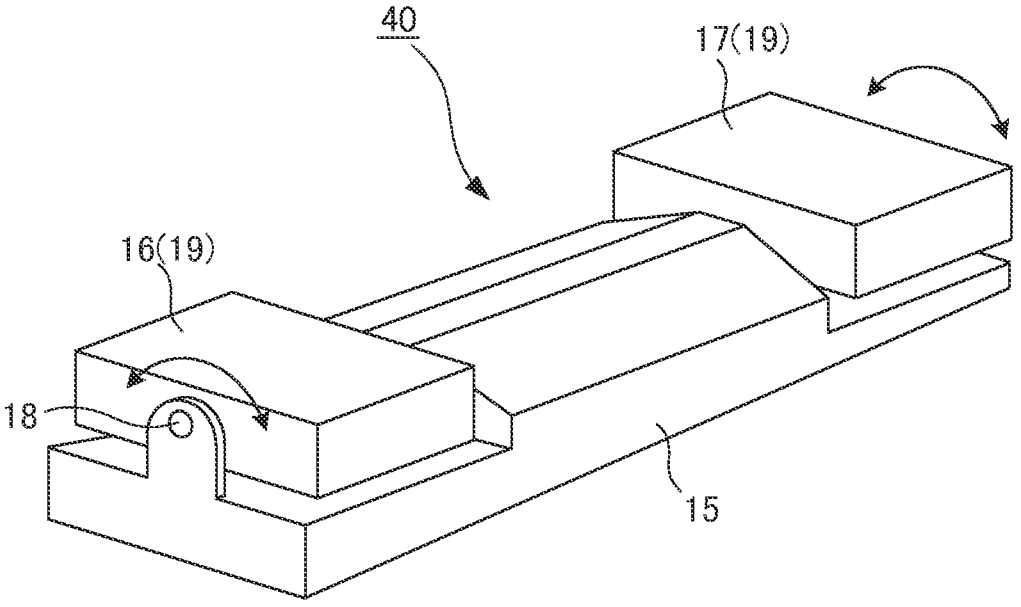
FIG. 3 is a first drawing for explaining a configuration of attachment to be set in the storage.
Figure 9:
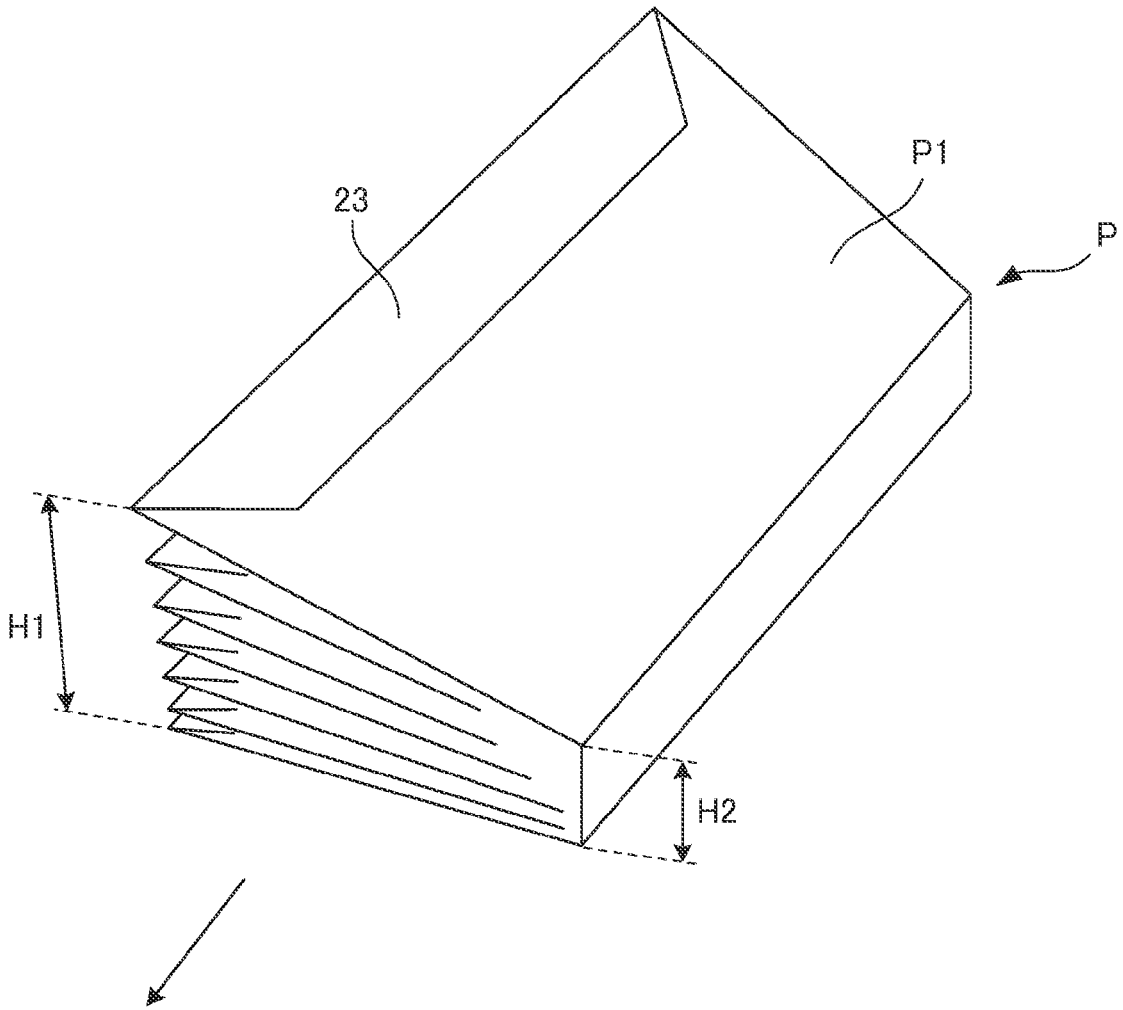
FIG. 9 is a drawing illustrating a state in which the envelopes are stacked.
Figure 10:
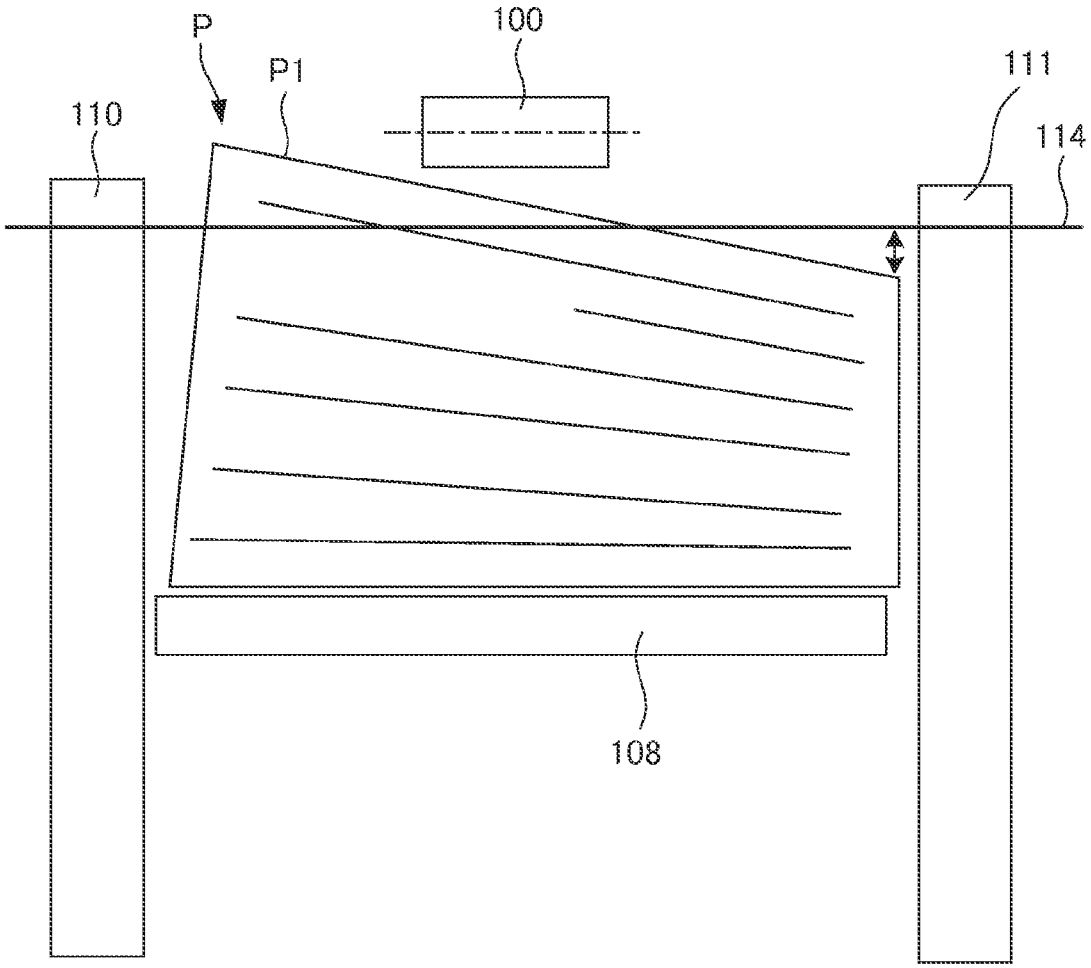
FIG.10 PRIOR ART
FIG. 10 is a drawing illustrating a state in which envelopes are stacked in a sheet feeding apparatus of the related art.

In this embodiment, in the sheet deck 101, not only the normal sheets, but also the envelopes P having different thicknesses with a flap as illustrated in FIG. 9 described above may be stored and fed. In this embodiment, when the envelopes P are stacked in the lifter tray 8, the envelopes P are placed so that the ends folded for forming the flaps are in contact with a regulating surface of one of the side regulating members 10 and 11. In other words, the envelopes P are stacked so that the flaps are positioned on one of the left and the right with respect to the center in the width direction extending orthogonal to the direction of sheet feeding. Here, when setting the envelopes P in the storage 7, an attachment 40 illustrated in FIG. 3 as a sheet holding apparatus configured to hold the topmost sheet stacked on the lifter tray 8 horizontally is set on the lifter tray 8. The attachment 40 may also be said to be a sheet stacking apparatus on which the sheets are stacked is placed on the lifter tray 8 as a supporting portion on which the attachment 40 is to be placed, and swingably supports the sheets in the storage 7.

The attachment 40 includes a base member 15 and swingable plates 16 and 17 as swingable members supported on an upper surface of the base member 15 so as to be swingable independently in a vertical direction along the width direction via a swinging shaft 18. The upper surface of the base member 15 is inclined and the sheet is fed along the upper surface of the base member 15. A direction in which the sheets are fed is the sheet feeding direction, and on the attachment 40, the downstream side is positioned to be higher by the inclination of the base member 15. In other words, the base member 15 is inclined so that the downstream end (first end) side in the sheet feeding direction (second direction) is positioned higher than the upstream end (second end) on the side opposite to the downstream end in the sheet feeding direction.

The base member 15 includes the swinging shaft 18 configured to swingably support the two swingable plates 16 and 17 attached thereto, and the swinging shaft 18 is arranged so as to be located at a center between the side regulating members 10 and 11 in parallel to the sheet feeding direction. In other words, the swingable plate 16 is a first sheet stacking member provided on the downstream end (first end) side in the sheet feeding direction (second direction), and the swingable plate 17 is a second sheet stacking member provided on the upstream end (second end) side in the sheet feeding direction of the base member 15. The swingable plates 16 and 17 are configured to be capable of swinging about the center (shaft center) of the swinging shaft 18 located at a substantially center of the base member 15 in the width direction as a center (swinging center) of the swingable motion 43. That is, the swingable plates 16 and 17 are supported such that both end portions of each of the swingable plates 16 and 17 swing up and down about a swinging center 43. The swingable plates 16 and 17 are inclined so that the downstream side is positioned higher than the upstream side along the inclination of the base member 15, which is inclined such that a side of the first end thereof in an axial direction of the swinging center is positioned higher than a side of the second end opposite to the first end, in the sheet feeding direction. In this embodiment, the swingable plates 16 and 17 constitute part of a sheet stacking portion 19 supported by the base member 15 so as to be swingable in the width direction orthogonal to the sheet feeding direction.

Here, there is a sheet of a type configured to cause a difference in stacking height when being stacked by a plurality of numbers due to the difference in thickness between a portion having the flap and a portion having no flap like the envelope P. As described later, in the case where the envelopes as sheets having different thicknesses on the left and the right in the width direction as well in this manner, the two swingable plates 16 and 17 are swingable in a direction of arrows independently so that the topmost envelope P extends substantially horizontally.

Figure 4:
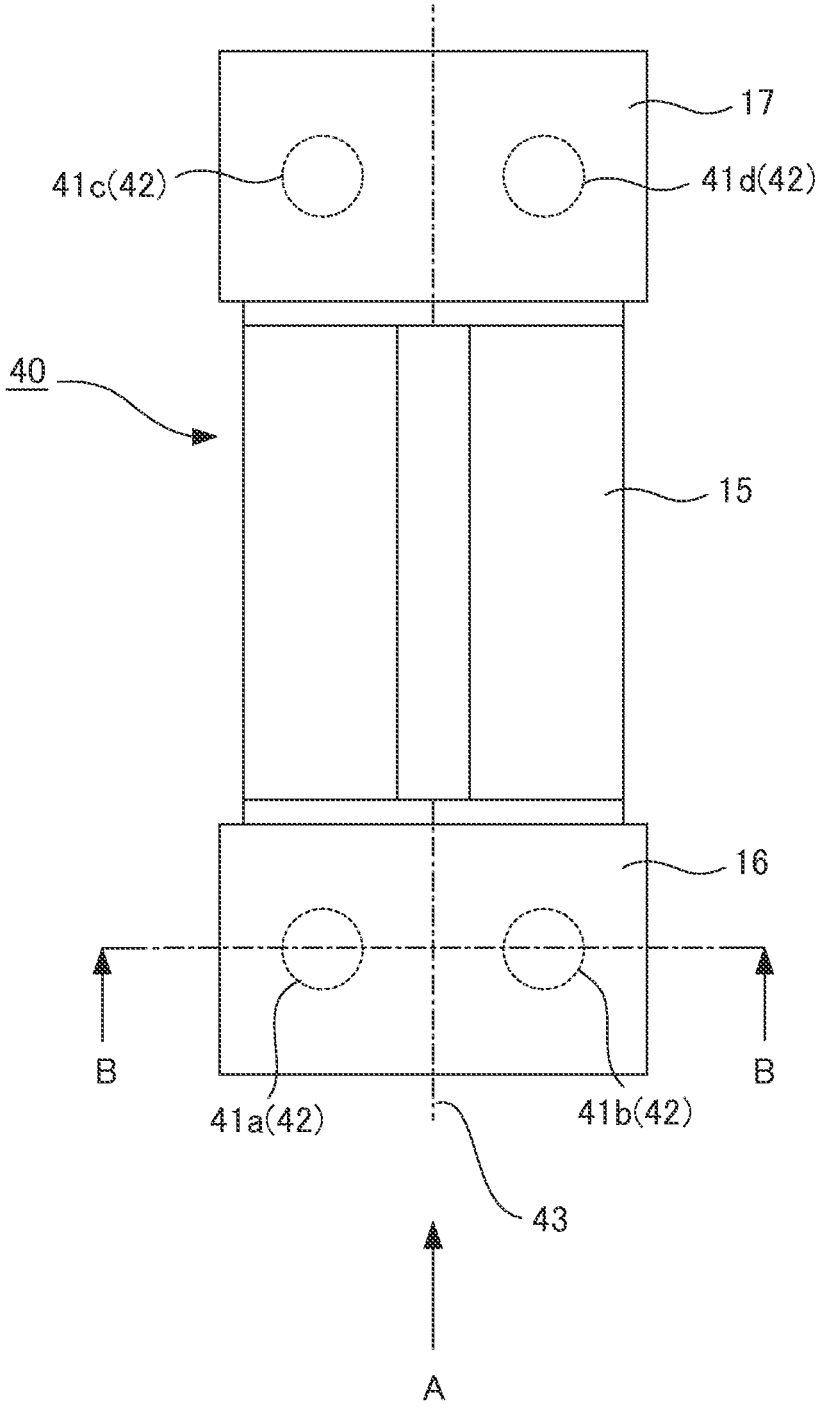
FIG. 4 is a second drawing for explaining the configuration of the attachment.

As illustrated in FIG. 4, arranged between the base member and the both side ends of the swingable plates 16 and 17 respectively are compression springs 41*a* to 41*d* which constitute part of biasing portions 42. The compression springs 41*a* to 41*d* are set so as to have a resilient force at the time when the swingable plates 16 and 17 are not swung in the width direction to be substantially the same, and in this embodiment, spring constants of the respective compression springs 41*a* to 41*d* are set to be substantially the same. In this manner, the spring constants of the spring set 41*a* and 41*b*, and the spring set 41*c* and 41*d* disposed on both sides of the swinging center 43 of the swingable plates 16 and 17 in the width direction (first direction) are substantially the same. Therefore, the compression springs 41*a* to 41*d* as the biasing portion are configured to bias the swingable plates 16 and 17 as the sheet stacking portion so as to reduce a swing angle in the width direction (first direction). In this configuration, when the envelopes P are fed by the first feed roller 1 as described later, the envelopes P are fed obliquely upward (sheet feeding direction).

Figure 5:
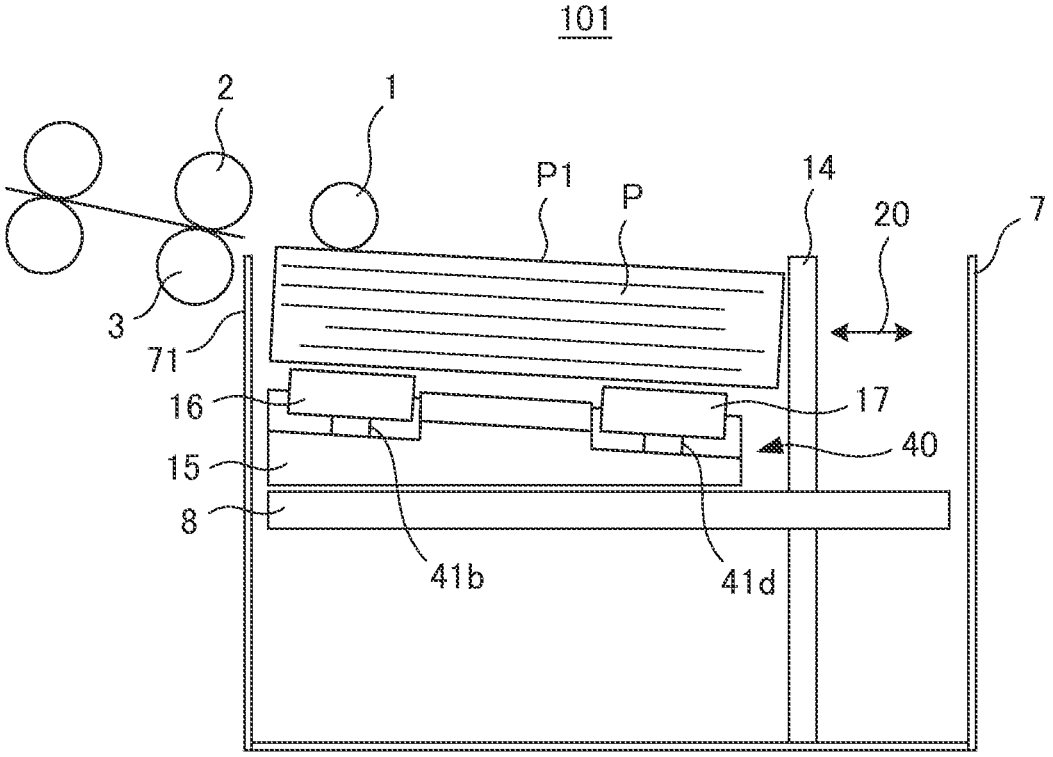
FIG. 5 is a drawing illustrating a state in which envelopes are placed on the attachment set on the sheet deck.

FIG. 5 is a drawing illustrating a state in which the envelopes P are stacked in a state in which the attachment 40 is set on the lifter tray 8. When setting the attachment 40, a projection, not illustrated, provided on a back surface of the attachment 40 is fitted into a positioning hole, not illustrated, on an upper surface of the lifter tray 8.

Here, when the envelopes P are stacked, the envelopes P make an attempt to move to the upstream side in the sheet feeding direction due to the inclination of the base member 15 as described above as illustrated in FIG. 5. However, the movement of the envelopes P is regulated by the trailing end regulating member 14, which is slidable along the sheet feeding direction indicated by an arrow 20. In FIG. 5, reference numeral 71 denotes a front wall portion provided on the downstream side of the storage 7 in the sheet feeding direction, and configured to regulate the movement of the envelopes P stored in the storage 7 toward the downstream side in the sheet feeding direction.

Figure 6A:
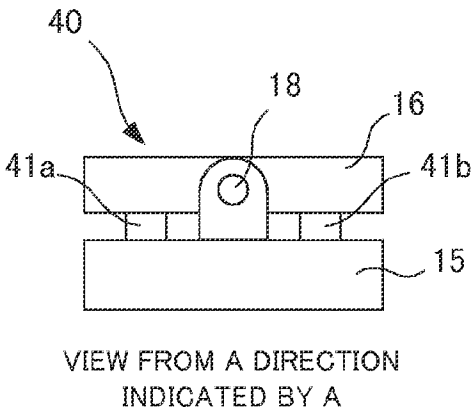
FIG. 6A is a front view of the attachment in FIG. 5 in a state in which a swingable plate is not swung in a width direction when viewed in a direction indicated by an arrow A.
Figure 6B:
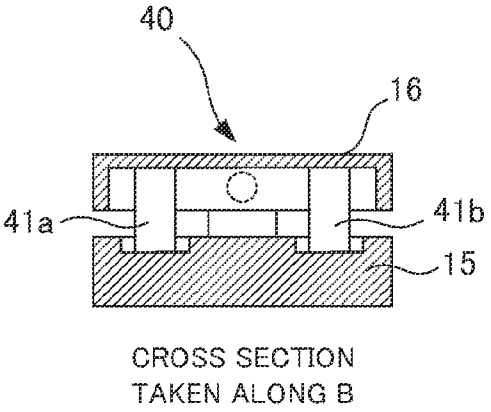
FIG. 6B is a cross-sectional view of the attachment illustrated in FIG. 6A.
Figure 6C:
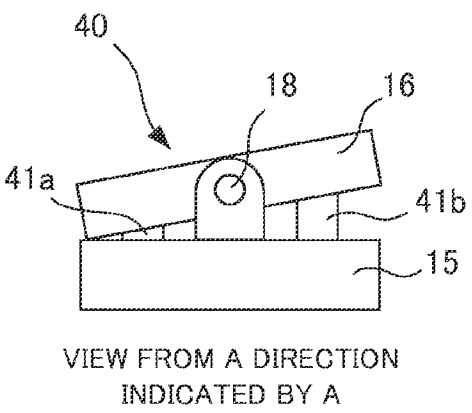
FIG. 6C is a front view of the attachment in FIG. 5 in a state in which the swingable plate swings toward a first end side in the width direction when viewed in the direction indicated by the arrow A.
Figure 6D:
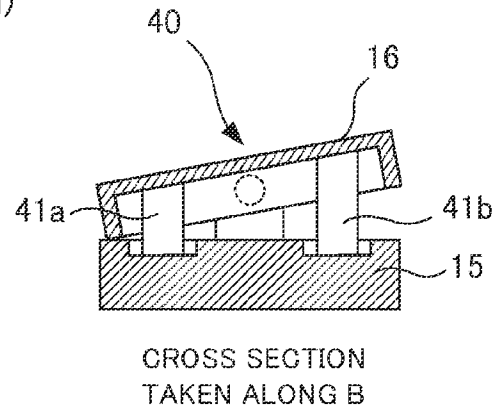
FIG. 6D is a cross-sectional view of the attachment illustrated in FIG. 6C.
Figure 6E:
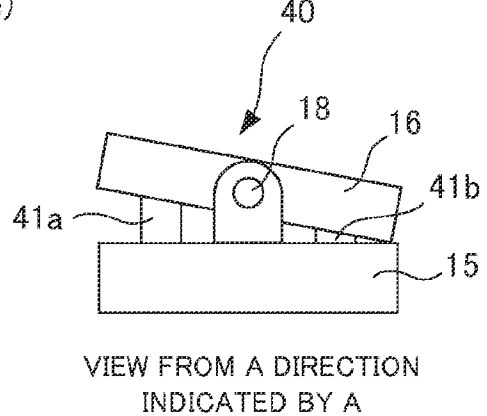
FIG. 6E is a front view of the attachment in FIG. 5 in a state in which the swingable plate is swung toward a second end side in the width direction when viewed in the direction indicated by the arrow A.
Figure 6F:
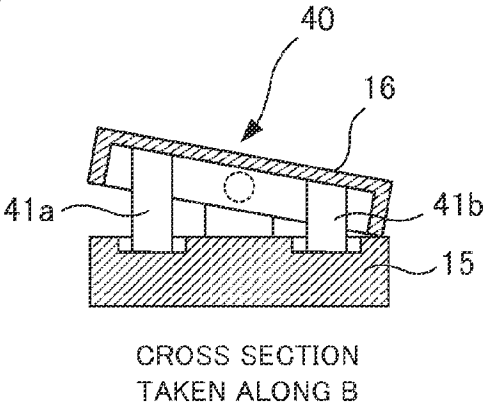
FIG. 6F is a cross-sectional view of the attachment illustrated in FIG. 6E.

Here, a plurality, two in this embodiment, of swingable plates 16 and 17 provided on the attachment 40 along the sheet feeding direction are held so that the upper surface of the envelope P1 does not incline in the width direction as illustrated in FIG. 6A and FIG. 6B by actions of the compression springs 41*a* to 41*d* until the envelops P are stacked. FIG. 6C and FIG. 6D illustrate a state in which the envelopes P are stacked on the swingable plates 16 and 17 and are inclined leftward, and FIG. 6E and FIG. 6F illustrates a state in which the swingable plates 16 and 17 are inclined rightward on the contrary. Furthermore, FIGS. 6A, 6C and 6E are drawings viewed in the direction indicated by an arrow A in FIG. 4, and FIGS. 6B, 6D, and 6F are cross-sectional views taken along a line B-B in FIG. 4. In the following description, a state in which the swingable plates 16 and 17 are not inclined in the width direction is referred to as a horizontal state, and the swingable plate 17 is also swingable in the width direction in the same manner as the swingable plate 16 in the FIGS. 6A to 6F and FIGS. 7A to 7C.

The compression springs 41*a* to 41*d* are held with the base member 15 as a base, and bias the swingable plates 16 and 17 from below to hold the swingable plates 16 and 17 horizontally. However, the compression springs 41*a* to 41*d* are capable of being resiliently deformed easily with a weak repulsive force. Therefore, until the envelopes are stacked, or in the case where the number of the envelopes are small, since a difference in load of the envelopes applied to the left and the right on both sides of the swingable plates 16 and 17 with respect to the swinging shaft 18 are small as illustrated in FIGS. 6A and 6B, the swingable plates 16 and 17 are maintained substantially horizontally. When the number of the stacked envelopes increases and the difference in load of the envelope applied to the left and right of the swingable plates 16 and 17 increases, the swingable plates 16 and 17 are inclined against the resilient forces of the compression springs 41*a* to 41*d*.

Therefore, in the case where the number of the envelopes is large, that is, when the load of a predetermined magnitude is applied by the envelopes, a holding force bows to the weight of the envelopes, so that the swingable plates 16 and 17 are inclined as illustrated in FIGS. 6C and 6D, or FIGS. 6E and 6F. In other words, although the swingable plates 16 and 17 are held horizontally until the load of the predetermined magnitude is applied by the compression springs 41*a* to 41*d*, the swingable plates 16 and 17 are inclined if a load of a predetermined magnitude is applied.

Here, when the envelopes are set for the first time, the swingable plates 16 and 17 are held horizontally as illustrated in FIGS. 6A and 6B, and hence the envelopes are not deviated, and the envelopes may be set easily. If a large number of the envelopes are placed, the swingable plates 16 and 17 are inclined as illustrated in FIGS. 6C and 6D, and FIGS. 6E and 6F, and if the envelopes are removed, the swingable plates 16 and 17 are returned to the horizontal state as illustrated in FIGS. 6A and 6B by the compression springs 41*a* to 41*d*.

Figure 7A:
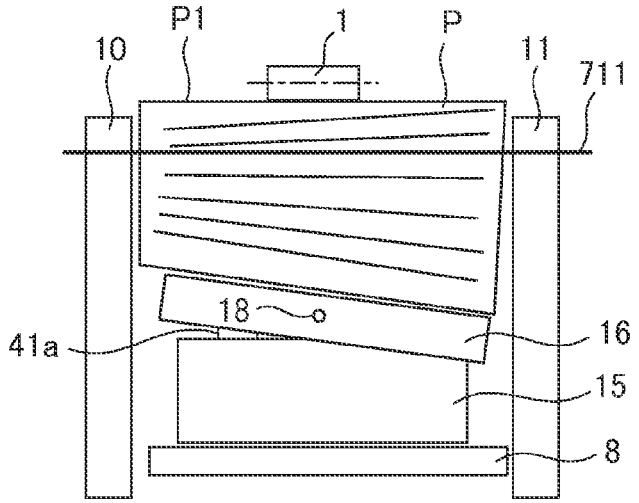
FIG. 7A is a front view illustrating the attachment in a state in which the envelopes are placed and the swingable plate is swung toward the first end side in the width direction.
Figure 7B:
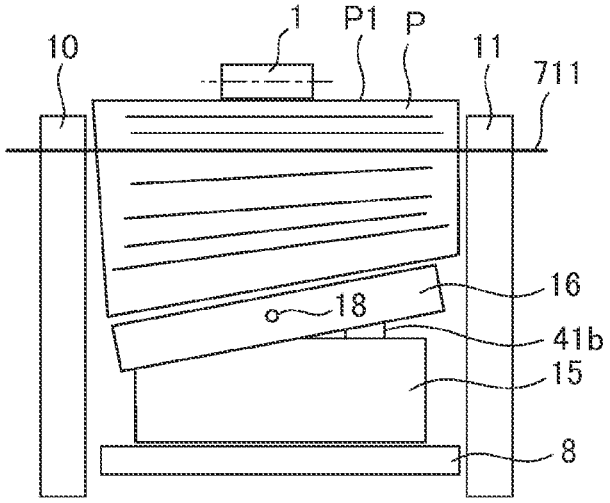
FIG. 7B is a front view illustrating the attachment in a state in which the envelopes are placed and the swingable plate is swung toward the second end side in the width direction.
Figure 7C:
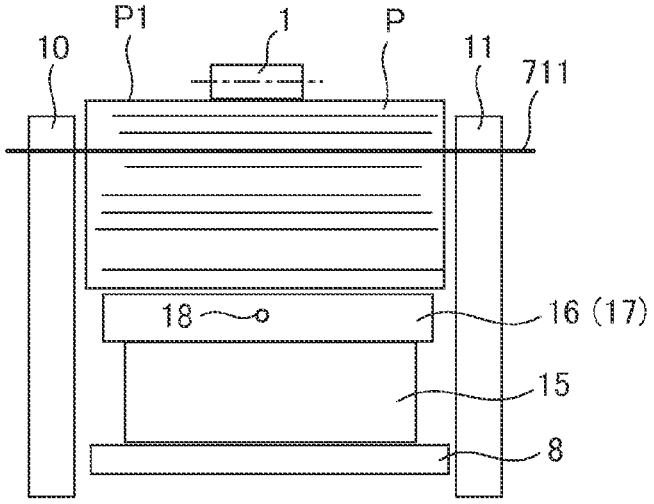
FIG. 7C is a front view illustrating the attachment in the state in which the envelopes having no flap are placed on the swingable plate.

FIGS. 7A and 7B are drawings illustrating the state of the attachment 40 when the bundle of the envelopes P is set. When the bundle of the envelope P is set, the swingable plates 16 and 17 are freely swingable, so that the side where the stacking height is large, that is, the thicker side where the flaps of the envelopes are located is lowered with the swinging shaft 18 as a supporting point and the side having the smaller stacking height is moved upward. Accordingly, the topmost envelope P1 is brought into the substantially horizontal state. In this manner, when the bundle of the envelopes P is set, the swingable plates 16 and 17 swings so as to absorb the difference in stacking height of the bundle of the envelopes P, whereby the topmost envelope P1 is brought into the substantially horizontal state. In FIGS. 7A to 7C, reference numeral 711 denotes an upper end of the front wall portion 71.

In this manner, when the number of the envelopes P is large, the topmost envelope P1 of the bundle of the envelopes P to be stacked thereon becomes substantially horizontal by the inclination of the swingable plates 16 and 17. In other words, as in this embodiment, the swingable plates 16 and 17 may be inclined freely in accordance with the weight of the bundle of the envelopes P, whereby the topmost envelope P1 of the bundle of the envelopes P may be held substantially horizontally.

By holding the topmost envelope P1 to be substantially horizontally, the first feed roller 1 may be brought into uniform abutment with the topmost envelope P1 without coming into one side abutment therewith, so that the envelopes P1 may be fed without slippage. FIG. 7C illustrates a state in which the envelopes having no flap are set for example. In this case, the swingable plates 16 and 17 are automatically balanced and the topmost envelope P1 may be held horizontally. Hereafter, by the lifter tray 8 moving upward, the topmost envelope P1 of the envelopes P stacked thereon is brought into abutment with the first feed roller 1 and are fed, are separated into pieces and conveyed by the second feed roller 2 and the retard roller 3, and are fed to the printer body 201A.

Figure 8:
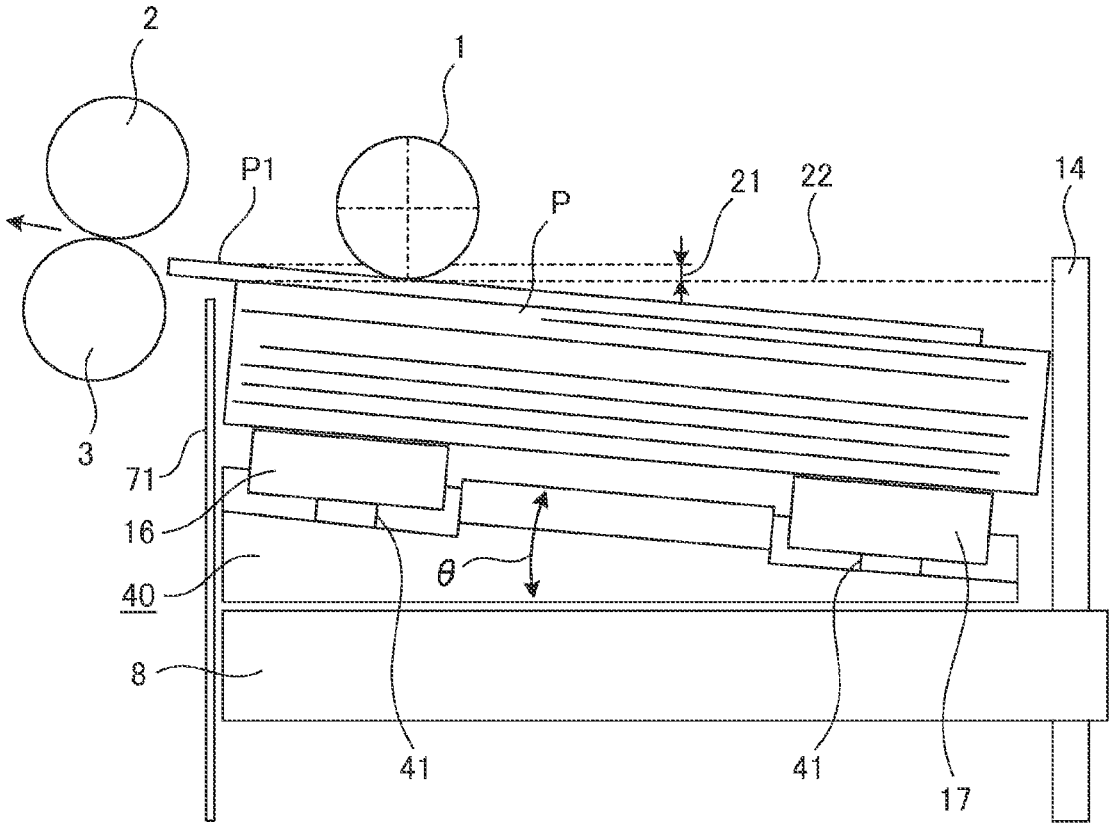
FIG. 8 is a drawing illustrating a state in which the envelopes placed on the attachment is fed out.

The base member 15 as described above is inclined so that the downstream side in the sheet feeding direction is positioned high. Accordingly, when being fed by the first feed roller 1, the topmost envelope P1 is fed obliquely upward by an angle of inclination θ of the base member 15 as illustrated in FIG. 8. In FIG. 8, reference numeral 22 denotes a horizontal line indicating an upper surface position of the topmost sheet in the case of feeding the normal sheet, and in the case where the normal sheets are fed, the upward and downward movement of the lifter tray 8 are controlled so that the topmost sheet is aligned with the horizontal line 22.

As in this embodiment, by feeding the envelope P1 obliquely upward, a distal end position of the envelope P1 may be positioned to be higher by a height indicated by an arrow 21 with respect to the horizontal line 22 with the first feed roller 1 as a base point as illustrated in FIG. 8. Accordingly, even with the envelope P1 having the flap, the envelope P1 may be caused to overcome the front wall portion 71, and fed smoothly toward the second feed roller 2 without colliding with the front wall portion 71 of the storage. In other words, as in this embodiment, the envelope P1 may be fed smoothly by inclining the base member 15. In the case where the sheets having no difference in thickness such as normal sheets are stored and fed, a large capacity stacking is enabled by removing the attachment 40, and stacking the sheets directly on the horizontal lifter tray 8.

Figure 11A:
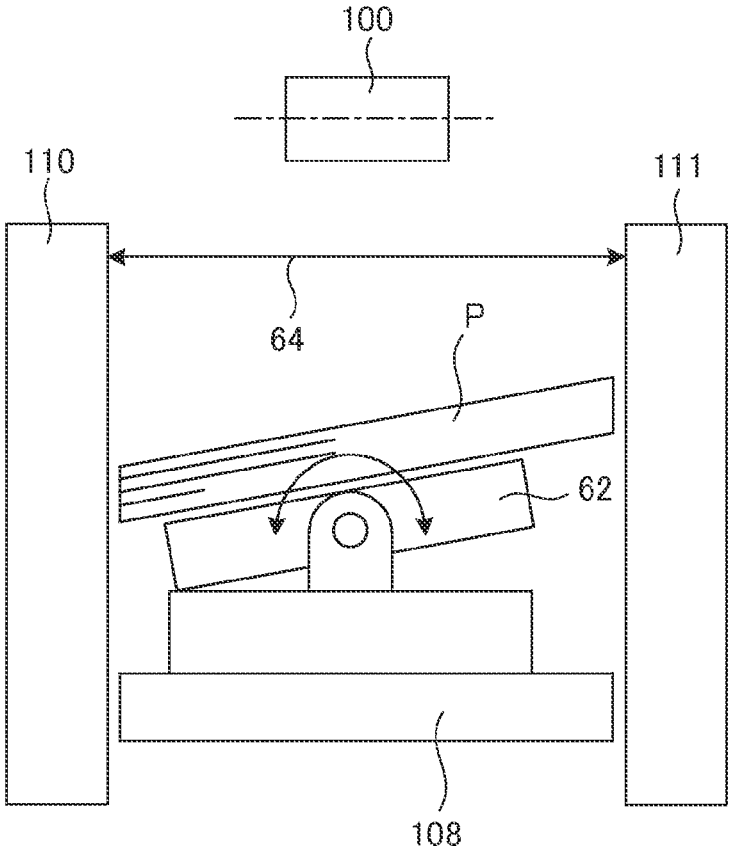
FIG. 11A is a drawing illustrating the attachment of a comparative example in a state in which the envelopes are placed on the inclined swingable plate.
Figure 11B:
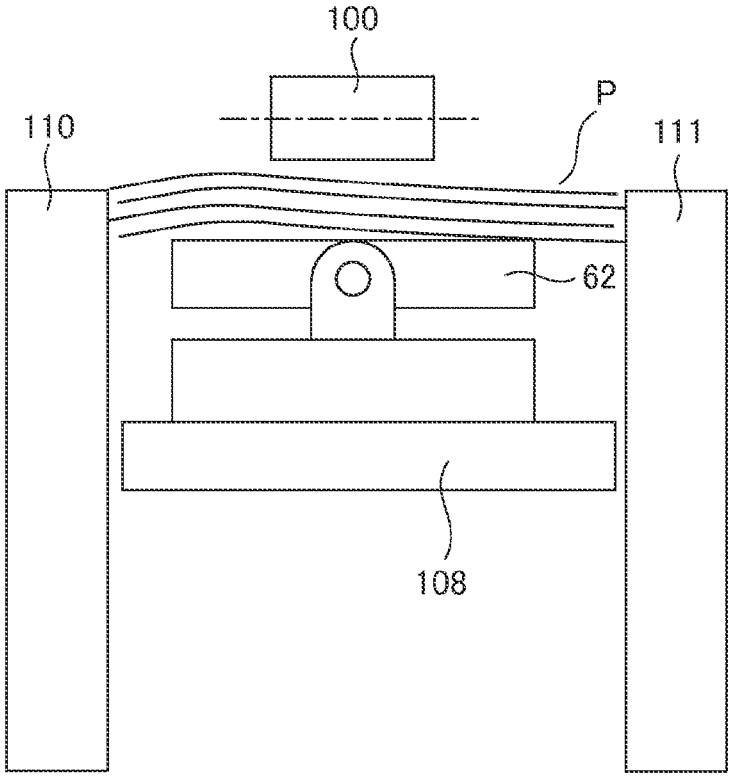
FIG. 11B is a drawing illustrating the attachment of FIG. 11A in a state in which the swingable plate is closer to the horizontal state.

In this manner, in the case of the attachment 40 of this embodiment, if a large number of the envelopes are placed, the swingable plates 16 and 17 are inclined naturally. Therefore, with this effect, the topmost envelope is maintained substantially horizontally, and the side regulating members 10 and 11 may be aligned correctly with the width of the envelope P. Accordingly, the envelopes P are prevented from being set in an inclined state. In other words, as illustrated in FIG. 11A, when the envelope P is set, it is not necessary to place the envelopes P on a significantly inclined attachment 62, and hence the set envelopes P are prevented from being deviated toward a side regulating plate 110 on one side and hence becoming unable to be set adequately. In addition, since there is no need to set the bundle of the envelopes P on the inclined attachment 62, and move the side regulating plates in this state in the width direction to align the ends of the envelopes P, a distance between the side regulating plates 110 and 111 indicated by an arrow 64 is not reduced by an amount of inclination to be narrower than the width of the envelopes P. Therefore, the envelopes P are fed in sequence, and the middle plate 108 moves upward, and the attachment 62 swings in the horizontal direction in association with the upward movement of the middle plate 108 and gets close to the horizontal state, the side ends of the envelopes P are not deflected by being press contacted with the side regulating plates 110 and 111 as illustrated in FIG. 11B. In other words, aligning the side regulating members to be narrow is prevented, and generation of the load at the time of feeding the envelope P and generation of feed failure due to the slippage of a pickup roller 100 by this load may be prevented.

As described above, in this embodiment, if the envelopes are stacked so that the thicknesses are different in the width direction, the swingable plates 16 and 17 swing against the compression springs 41*a* to 41*d* so that the ends of the envelopes having a larger thickness are positioned lower than the other ends thereof, so that the topmost envelope may be held substantially horizontally. When the envelopes are stacked, the swingable plates 16 and 17 are swung to hold the topmost envelope to be substantially horizontally, so that the envelopes having a non-uniform thickness may be fed reliably.

In the description given thus far, although the attachment 40 is configured to be demountably mounted, even for that fixed to the lifter tray 8, the same effects and advantages are achieved. Although the compression springs 41*a* to 41*d* are used for holding the swingable plates 16 and 17 horizontally, components such as a tensile spring or a rubber spring configured to generate a holding force resiliently may be employed apart from the compression spring 41. In addition, although the two swingable plates are provided as the attachment 40, the configuration having one swingable plate elongated in the sheet feeding direction is also applicable.

In the description given thus far, the both side ends of the swingable plates 16 and 17 are biased by the compression springs 41*a* to 41*d* to maintain the swingable plates 16 and 17 horizontally. However, this disclosure is not limited thereto, and at least one of the both side ends may be biased by a spring. That is, the biasing portion may be disposed between the base member and the sheet stacking portion on at least one of both sides with the swinging center interposed therebetween. For example, by setting the orientation of the envelopes to be set, and biasing one of the both side ends of the swingable plates 16 and 17 with the compression spring, if the envelopes are stacked, the swingable plates 16 and 17 swing to hold the topmost envelope to be horizontal.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-001948, filed Jan. 8, 2014, which is hereby incorporated by reference herein in its entirety.

What is claimed is:

1. A sheet stacking apparatus for supporting stacked sheets within a sheet storage portion, the sheet stacking apparatus comprising:

a base member;

a sheet stacking portion on which sheets are stacked, the sheet stacking portion being supported by the base member such that both end portions of the sheet stacking portion swing up and down about a swinging center;

a first biasing member biasing one end portion of the sheet stacking portion against the swinging center; and a second biasing member biasing another end portion of the sheet stacking portion against the swinging center, wherein both end portions of the sheet stacking portion are held at substantially the same level by the first and second biasing members.

2. The sheet stacking apparatus according to claim 1, wherein the first and second biasing members disposed on the end portions with the swinging center interposed therebetween are configured to have substantially the same resilient force in a condition in which the sheet stacking portion is not swung.

3. The sheet stacking apparatus according to claim 1, the base member configured to be inclined such that a side of a first end thereof in an axial direction of the swinging center is positioned higher than a side of a second end opposite to the first end.

4. The sheet stacking apparatus according to claim 1, wherein the sheet stacking portion includes a first sheet stacking member provided on a side of a first end of the base member in an axial direction of the swinging center, and a second sheet stacking member provided on a side of a second end, opposite to the first end in the axial direction, of the base member, and wherein each of the first and the second stacking members is configured to swing about the swinging center.

5. The sheet stacking apparatus according to claim 4, wherein the base member is configured to be inclined such that the side of the first end in the axial direction of the swinging center is positioned higher than the side of the second end.

6. The sheet stacking apparatus according to claim 1, wherein the first and second biasing members reduce a swing angle of the sheet stacking portion.

7. The sheet stacking apparatus according to claim 1, wherein the first and second biasing members respectively include a compression spring.

8. A sheet feeding apparatus comprising:

a sheet stacking apparatus including:

a base member;

a sheet stacking portion on which sheets are stacked, the sheet stacking portion being supported by the base member such that both end portions of the sheet stacking portion swing up and down about a swinging center;

a first biasing member biasing one end portion of the sheet stacking portion against the swinging center; and a second biasing member biasing another end portion of the sheet stacking portion against the swinging center;

a sheet storage portion including a sheet storage portion body configured to store sheets, and a supporting portion which is provided on the sheet storage portion body so as to be capable of elevating, and on which the base member of the sheet stacking apparatus is placed; and a sheet feed portion provided above the supporting portion and configured to feed the sheet in abutment with the topmost sheet from among the sheets stacked on the sheet stacking portion, wherein both end portions of the sheet stacking portion are held at substantially the same level by the first and second biasing members, and wherein the axial direction of the swinging center corresponds to a sheet feeding direction.

9. The sheet feeding apparatus according to claim 8, wherein the base member is configured to be inclined such that a first end side in the sheet feeding direction as a downstream side in the sheet feeding direction is higher than a second end side in the sheet feeding direction as an upstream side in the sheet feeding direction.

10. The sheet feeding apparatus according to claim 8, wherein the sheet stacking apparatus is configured to be demountably mountable with respect to the supporting portion.

11. The sheet feeding apparatus according to claim 8, further comprising a side regulating member configured to regulate the position of the sheets stacked on the sheet stacking portion in a width direction orthogonal to the axial direction of the swinging center.

12. An image forming apparatus comprising:

a feeding apparatus including:

a sheet stacking apparatus including:

a base member;

a sheet stacking portion on which sheets are stacked, the sheet stacking portion being supported by the base member such that both end portions of the sheet stacking portion swing up and down about a swinging center;

a first biasing member biasing one end portion of the sheet stacking portion against the swinging center; and a second biasing member biasing another end portion of the sheet stacking portion against the swinging center;

a sheet storage portion including a sheet storage portion body configured to store sheets, and a supporting portion which is provided on the sheet storage portion body so as to be capable of elevating, and on which the base member of the sheet stacking apparatus is placed; and a sheet feed portion provided above the supporting portion and configured to feed the sheet in abutment with the topmost sheet from among the sheets stacked on the sheet stacking portion; and an image forming portion configured to form an image on a sheet fed by the sheet feeding apparatus, wherein both end portions of the sheet stacking portion are held at substantially the same level by the first and second biasing members, and wherein the axial direction of the swinging center corresponds to a sheet feeding direction.

* * * * *